US005219395A

United States Patent [19]

Spieldiener et al.

[11] Patent Number: 5,219,395

[45] Date of Patent: Jun. 15, 1993

[54] MONORAIL TRANSPORT SYSTEM

[76] Inventors: Robert Spieldiener, P.O. Box 356, Im Muhleholz 14, FL - 9490 Vaduz, Liechtenstein; Reinhold Spieldiener, Aussichtsstrasse 23, CH - 8704 Herrliberg; Alfons Saiko, Speerstrasse 26A, CH - 8942 Oberrieden, both of Switzerland

[21] Appl. No.: 840,123

[22] Filed: Feb. 24, 1992

[51] Int. Cl.[5] ..... E01B 25/00

[52] U.S. Cl. ..... 104/130; 104/27; 104/102

[58] Field of Search ..... 104/130, 130.1, 118, 104/27, 28, 119, 91, 96, 102, 100, 103

[56] References Cited

U.S. PATENT DOCUMENTS

| | | | |
|---|---|---|---|
| 2,903,972 | 9/1959 | Schutze | 104/130 |
| 2,993,647 | 7/1961 | Deller | 104/130 |
| 3,093,090 | 6/1963 | Rosenbaum | 104/130 |
| 3,675,584 | 7/1972 | Hall | 104/28 |
| 3,865,040 | 2/1975 | Steen | 104/130 |
| 4,016,818 | 4/1977 | Ellzey | 104/130 |
| 4,094,252 | 6/1978 | Pater et al. | 104/130 |

FOREIGN PATENT DOCUMENTS

| | | | |
|---|---|---|---|
| 0714654 | 7/1965 | Canada | 104/130 |
| 209375 | 6/1960 | Fed. Rep. of Germany | 104/130 |
| 1220188 | 5/1960 | France | 104/130 |
| 0096881 | 8/1957 | Norway | 104/130 |

*Primary Examiner*—Mark T. Le
*Attorney, Agent, or Firm*—Bielen, Peterson & Lampe

[57] ABSTRACT

A monorail public transport system utilizing a plurality of independent cars that circulate a main route with shunting of select cars to passenger loading stations without substantial interference of the continuous circulation of the remaining cars on a circuitous main route, wherein the shunting is accomplished by a high-speed switching mechanism having multiple segmented articulated rails having one segment that is pivotally anchored for pivoting the rail.

11 Claims, 5 Drawing Sheets

Fig. 5
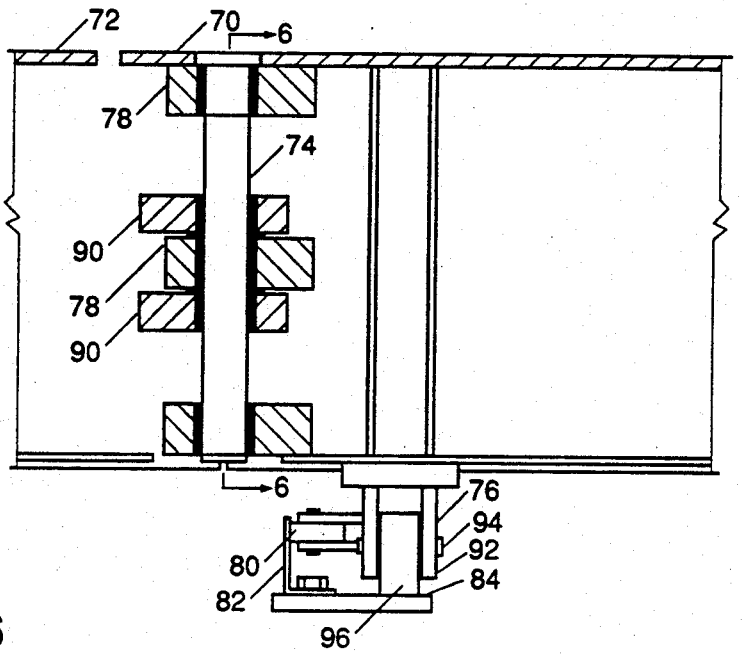
Fig. 6
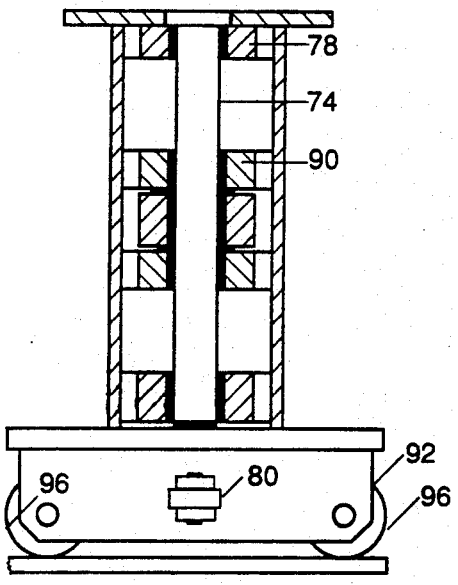
Fig. 11
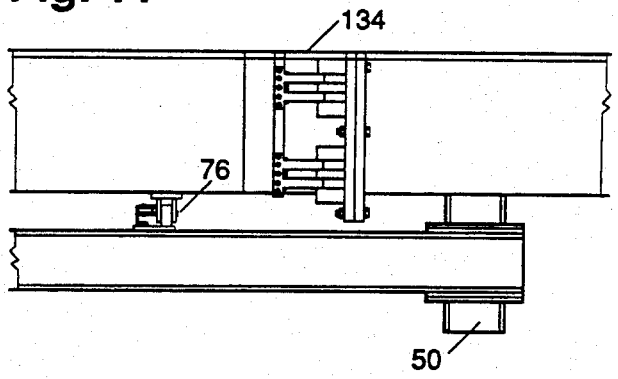
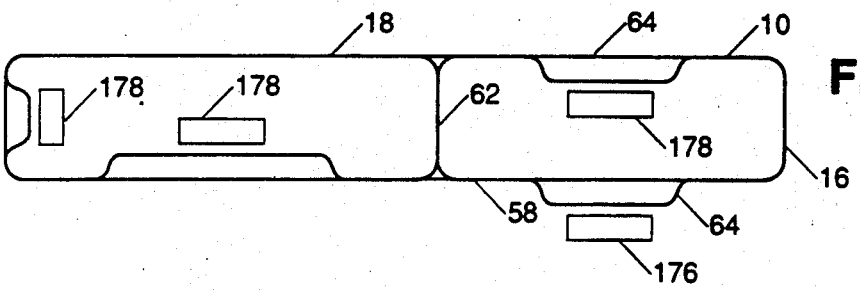
Fig. 14

MONORAIL TRANSPORT SYSTEM

BACKGROUND OF THE INVENTION

This invention relates to a monorail system and in particular relates to a monorail track system having a high-speed track switching mechanism.

In the past, most systems devised for monorail tracks have been train systems having multiple, interconnected cars making periodic and predetermined stops at central loading stations. As such, the necessity for a reliable, high-speed track switching mechanism has not been high. Customarily, track switching is required primarily at repair depots and other service areas where one or more cars or trains may be sidelined for removal from service during off peak hours or repair. In situations where transport systems have multiple routes, and track switching is required, for route changes, switching mechanisms have substantial lead time to accomplish the track switch before the passenger train arrives at the switching junction.

In the monorail system devised, however, cars are not coupled in an elongated train, but are individually propelled along the track and are selectively removed from the track route to a station for passenger loading. The remaining cars not directed at a local station continue on the common route to their destination. In the preferred embodiment, the individual cars are relatively small such that they constitute personalized vehicles equivalent to a common taxi cab. In such a situation, where each car carries from one to four passengers, the number of cars on the service route must be substantially increased and the switching action to divert a single car for passenger pick-up or unloading must be virtually instantaneous in order that the unswitched cars are not delayed and are not affected by diversions of individual cars.

The absence of a safe and reliable, high-speed, switching mechanism to remove cars from a common service route and return them the route after loading or unloading has impeded the adoption of a personalized-type of transit system.

The capital costs to construct a public transport system requires a passenger capacity that was not previously possible for independent rail car systems. The devised system with the high-speed, track switching mechanism has enabled the necessary passenger capacity to be achieved for a service route with multiple stations. By incorporation of a scheme that diverts only those cars to stations as commanded by passengers, the remaining cars on the service route can proceed to their specified destination, by-passing intermediate stations. This scheme enables a continuous steady flow of cars along the service route with a minimum spacing between cars.

SUMMARY OF THE INVENTION

This invention relates to a monorail public transport system. In particular, the invention relates to a system that utilizes a plurality of independent cars that circulate a main route with shunting of select cars to passenger loading and unloading stations. The continuous travel of cars on a main circuit line to an ultimate destination before diversion from the common line to a station line enables the system to operate at a passenger capacity that is typical of a public transport system. Key to the operation of the system is a low-mass, track switching mechanism, that incorporates unique features for high speed switching for diversion of select cars to a passenger loading or unloading station. A similar low-mass track switch mechanism enables cars at a passenger station to be returned to the main line upon receiving a clearance signal signaling safe reentry.

The individual cars of the preferred embodiment are designed to seat three adults with additional cab space for auxiliary seating, for accommodating luggage, or passengers that are wheelchair bound. The high speed track switching mechanisms can be used for other functions in a rail system such as for diverting cars to storage or repair facilities.

BRIEF DESCRIPTION OF THE DRAWINGS

FIG. 5 is a side elevational view of a typical articulation joint in the track switching mechanism.

FIG. 6 is a cross-sectional view taken on the lines 6—6 in FIG. 5.

FIG. 11 is a partial side elevational view of the locking mechanism of FIG. 8.

FIG. 14 is a typical track network for the transport system of this invention.

DESCRIPTION OF THE PREFERRED EMBODIMENTS

Figure 1:
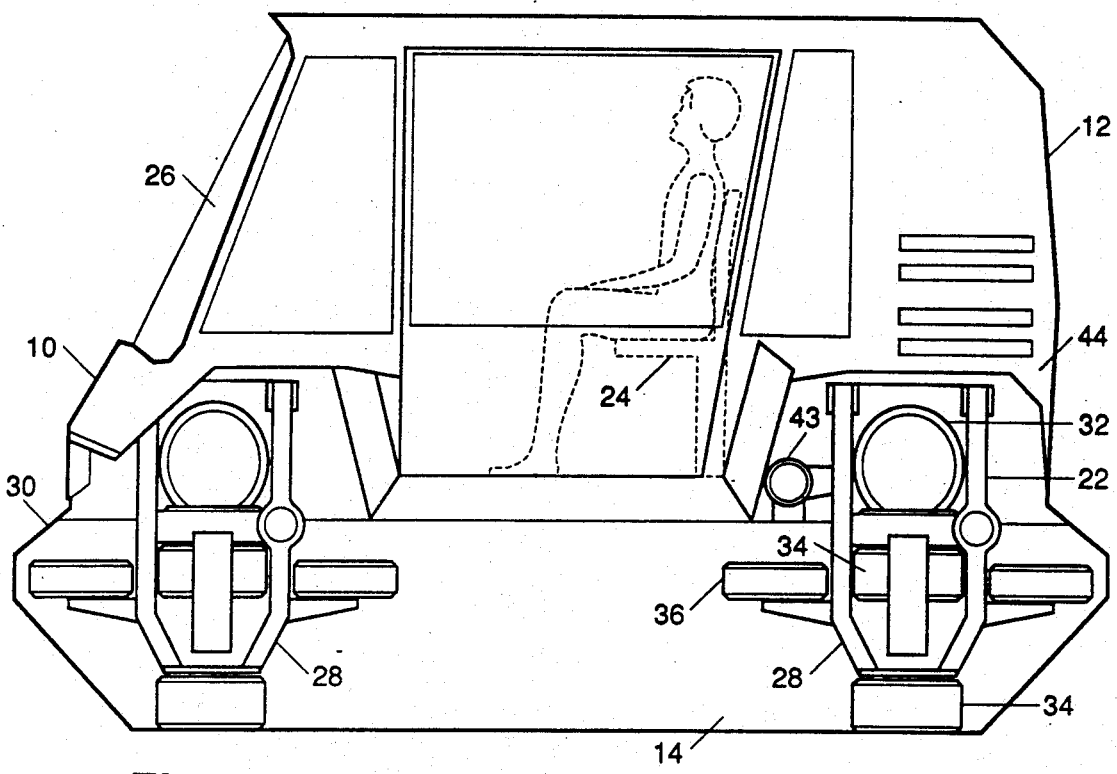
FIG. 1 is a side elevational view, partially fragmented, of a passenger car used in the transport system of this invention.
Figure 2:
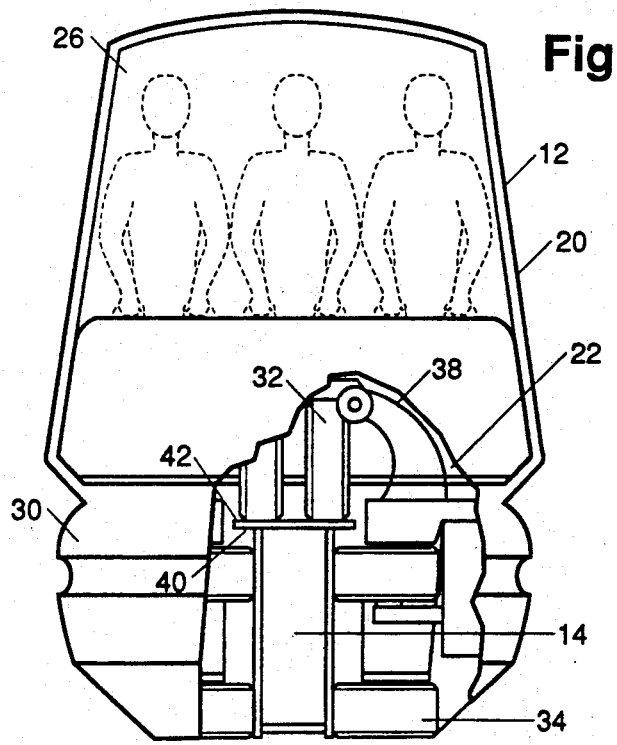
FIG. 2 is a front elevational view, partially fragmented, of the car of FIG. 1.

The monorail transport system of this invention is designated generally by the reference numeral 10 and includes a number of individual disconnected cars, as exemplified by the car 12 in FIGS. 1 and 2 on a monorail track 14. The track 14 forms part of a monorail track network 16 that typically is in the form of a continuous service loop 18 as schematically illustrated in FIG. 14.

Referring to FIGS. 1 and 2, each car 12 has a cab 20 on a supporting chassis 22 that is propelled on the fixed track 14 that is customarily elevated and of a T configuration to lock each car 12 to the track during operation. The cab 20 is spacious with ample room for three or more passengers and luggage. Pivoting seats 24 enable convenient wheelchair use of available space. Expansive windows 26 allow for panoramic visibility. The chassis 24 has identical front and rear tracking wheel assemblies 28. Each wheel assembly 28 is contained under a protective cowling 30 and incudes top support wheels 32, opposed pairs of side wheels 34 and fore and aft tracking rollers 36. The side wheels 34 provide vertical stability to the cab and the fore and aft rollers 36 provide a smooth ride over joints in the track. The stabilization side wheels 34 and tracking rollers 36 are mounted on pivoting assembly arms 38. Pivot of the arms 38 allows the arms to clear the side wheels from the lip 40 of the top plate 42 of the monorail track. This operation permits the car to be vertically disengaged from the track for installation or replacement.

The individual cars are light in weight and are propelled by a small electric motor or hybrid, light-weight engine/motor device 43 in a drive motor compartment 44 providing efficient electronic control of the means for propulsion and braking. The light-weight design of the individual cars enables a corresponding light-weight construction to the track network 16. High speed operation of a novel switching mechanism is in turn enhanced by the low-mass, steel plate construction of the track 14 as shown in the FIG. 2.

Figure 3:
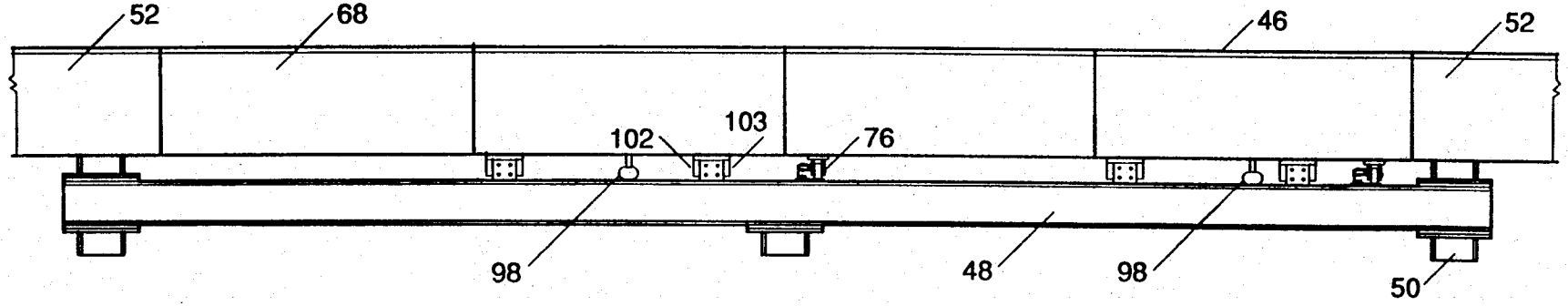
FIG. 3 is a side elevational view of a track switching mechanism used in the transport system.

The high-speed track switching mechanism 46 is supported on an elevated support beam 48 mounted on posts 50 typically as shown in FIG. 3. Fixed segments 52 of the track 14 are positioned at each end of the switching mechanism and may be directly supported by posts between the locations of switching mechanisms.

Figure 4:
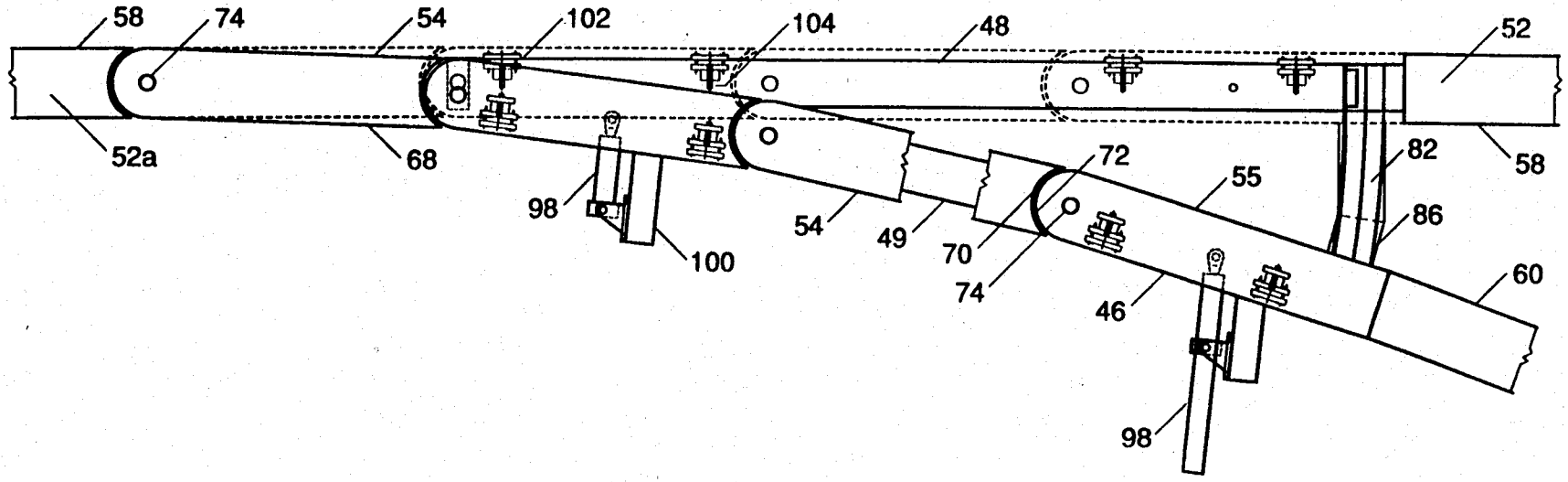
FIG. 4 is a top plan view of the one-rail switching mechanism of FIG. 3.
Figure 7:
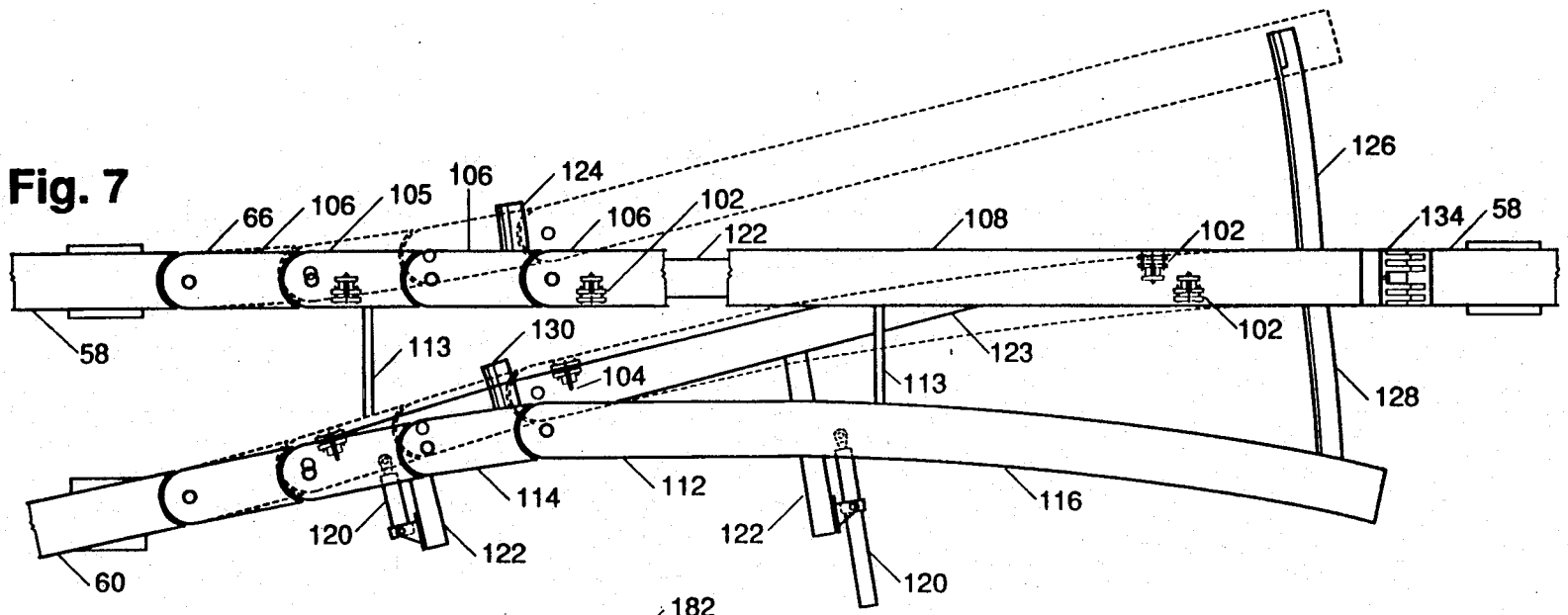
FIG. 7 is plan view of a two rail switching mechanism used in the transport system.
Figure 12:
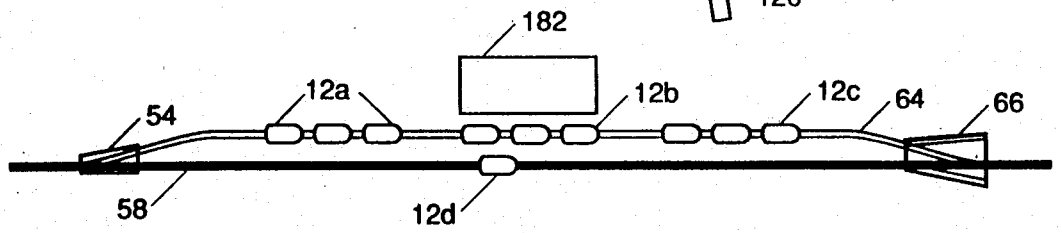
FIG. 12 is a schematic view of a typical loading station arrangement.
Figure 13:
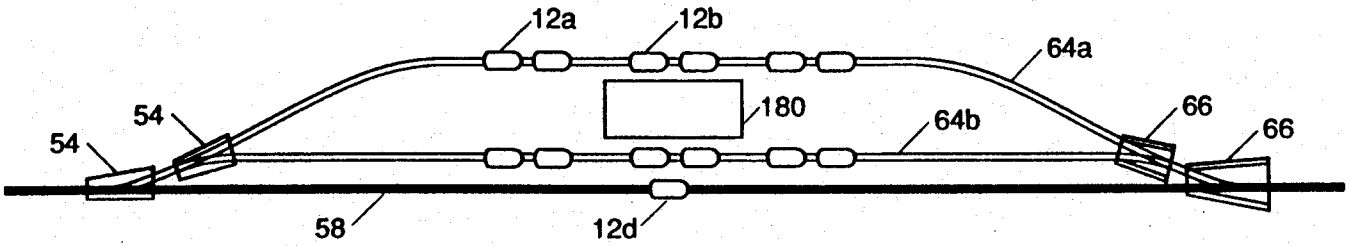
FIG. 13 is a schematic view of an alternate loading station configuration.

As shown in FIGS. 4 and 7 the switching mechanisms 46 are in two distinct configurations. A switching mechanism 54 having an articulated single rail 55 is devised for switching a car from a common service route line 58 to a side line 60 that may be used for an alternate route line 62 as shown schematically in FIG. 14 or a station line 64 as shown in FIGS. 12–14. The double-rail articulated switching mechanism 66 shown in FIG. 7 is devised for switching a car from a side line 60 onto the service route line 58 as shown in the referenced FIGS. 12–14.

In the plan view of FIG. 4, the single-rail, articulated switching mechanism 54 has four articulated straight segments 68, each segment 68 having a rounded end 70 connected to the contoured end 72 of the adjacent segment, or in the case of the first segment to the fixed track segment 52*a*, by a pivot pin 74. The four articulated segments are supported on roller units 76, that ride on a horizontal track plate 84. The track plate is supported on a projecting support strut 86 on the beams 48 and 49.

The detail of the typical roller unit 76 and pivot pin 74 is shown in FIGS. 5 and 6. The pivot pin 74 seats in internal hinge blocks 78 on the rounded end 70 and through interconnecting hinge blocks 90 on the contoured end 72 of the adjacent segment such that a hinge joint is formed allowing limited pivotal articulation. The roller unit 76 is welded to the underside of an appropriate articulated segment for support of the span created by the linked segments. For the light weight cars used in this system, two roller units for each span is sufficient. The typical roller unit 76 of FIGS. 5 and 6 has a bracket 92 with journal pins 94 for support rollers 96 that rolls on a track plate 84. The typical track plate 84 includes a curved lateral guide plate 82 engaged by a lateral roller 80.

Actuation of the single-rail switching mechanism 54 is accomplished by spaced hydraulic actuators 98 mounted on extension arms 100 projecting from a support beam 49 under the articulated segments 68 position for car diversion as shown in FIG. 4. The alternate position for straight line operation is shown in dotted the dotted line in FIG. 4. Preferably each of the two actuator locations has two actuators with separate hydraulic controls for double redundancy to insure safe operation in the event one actuator fails.

On each side of each actuator location are bumpers 102 (shown in plan views for clarity) mounted to the support beams, which contact stops 103 on the swinging track segments 68. The bumpers 102 are each equipped with a depressible switch 104 which signals the position of the track segments 68 to coordinate the automated operation of the transport system.

Referring to the plan view of FIG. 7, the double-rail, articulated, switching mechanism 66 is shown. One rail 105 of the double-rail mechanism includes three short, articulated segments 106 having a long straight segment 108 connected to the end of the short segments anchored to the common service route line 58. The other rail 112 of the double rail mechanism 66 includes three short, articulated track, segments 114 having an elongated arcuate segment 116 connected to the end of the short segments anchored to the side line 60 leading to the common line 58. The two rails 105 and 112 are interconnected by struts 113 to shift the rails in tandem when actuated by the hydraulic actuators 120 mounted on extension arms 122.

The rails 105 and 112 are supported over beams, 122 and 123, which are carried by roller units 76 detailed in FIGS. 5 and 6. The roller units 76 ride on arcuate track plates 124, 126, 128 and 130. Bumpers 102 are mounted on the underlying beams 122 and 123, and contact stops on the articulated rails in the manner previously described for the single-rail mechanism.

To insure that the car carrying rail is properly maintained in position when a car is riding over the switching mechanism a locking mechanism is incorporated between the distal end of the articulated switching rail and the end of the fixed track that abuts rail end. The locking mechanism 134, shown in FIGS. 8–10 incorporates a spring-loaded head 136 slidably engaged with the fixed end segment 52*a* by interlaced fingers 138, which engage slots 140 as shown in FIGS. 8 and 9 with the head 136 in its extended position.

The locking mechanism 134 has an end plate 141 which engages an end recess 142 in the distal end 144 of each of the pivotal switch rails 55, 105 and 112 of FIGS. 4 and 7, when the head 136 is extended. Extension of the head is accomplished by the force of two compression springs 146 seated in retainers 148 and 150. The compression springs 146 are arranged around guide cylinders 152 which are slidably engaged in a slide bearing 154 in guide blocks 156. The guide blocks 156 are mounted on the fixed end plates 158 and 160 of the track end segment 52*a* and are coupled by bolts 162 for inspection and repair.

Figure 10:
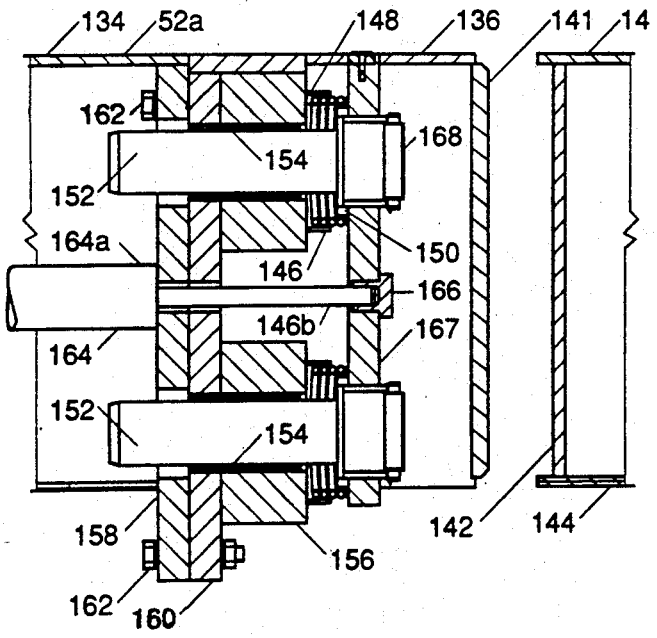
FIG. 10 is a cross-sectional view taken on the lines 10—10 in FIG. 9.

Retraction of the spring biased head 136 as shown in FIG. 10 is accomplished by displacement of a pair of hydraulic pistons 164*b* of hydraulic actuators 164*a* (one shown). Each piston 164 connects to a boss 166 in the head plate 167 that anchors the guide cylinders by end collets 168 for retraction and extension of the head 136.

Figure 8:
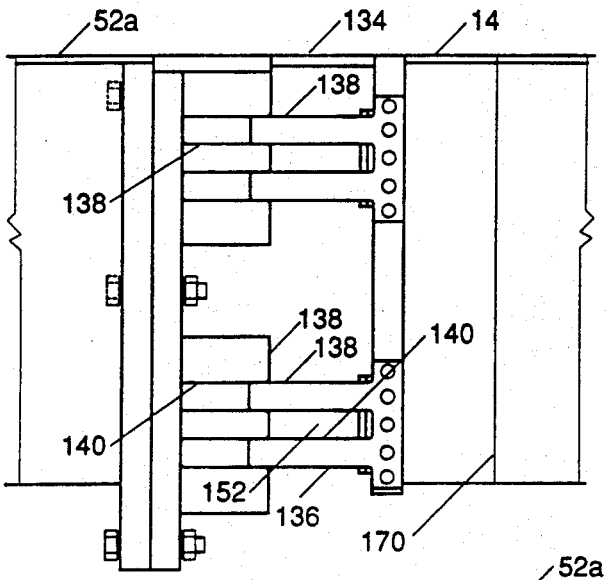
FIG. 8 is a side elevational view of a locking mechanism used in the transport system.
Figure 9:
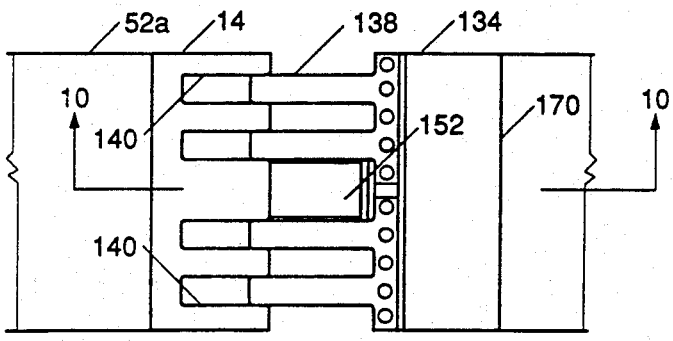
FIG. 9 is a top plan view of the locking mechanism of FIG. 8.

The locking mechanism 134 functions as an expansion joint as extension from the retracted position shown in FIG. 10 is accomplished by release of the actuator retraction allowing a range in which the head can extend to seat in the abutting end 144 of the switching track 14 to form the tight joint 170 as shown in the extended position of FIGS. 8 and 9. The interlaced fingers 138 in the side of the track 14 as shown in FIG. 8 and the interlaced fingers 138 in the top of the track 14 as shown in the FIG. 9 allow continuous, smooth tracking of the tracking wheel assemblies 28 of the car 12 shown in FIGS. 1 and 2.

In operation, the transport system 10 has a typical network 16 as shown in FIG. 14. The network shown, has a main service loop 18 with a common service route line 58 and an alternate route line 62. The service route line 58 has a series of station lines 64 which may be configured as shown in FIGS. 12 and 13.

The low mass switching mechanisms 46 are designed for high speed operation such that on electronic command, the switching operation can be accomplished in approximately five seconds. Because of the articulated construction of the switch rails, a greater curvature can be developed for a given length enabling the switch rail length to be substantially reduced while at the same time allowing the main line rail to be straight. Additionally, anchoring one end and displacing the rail in a pivotal motion reduces the mass needed to be moved. These features enable an 8.5 meter switch rail to be switched and locked within a five second switch time. This in turn enables a minimum five second displacement between cars.

In operation, a computer command center station 176 centralizes computer control of the network. Although each car has a control processor for insuring basic safety features such as radar controlled car spacing, emergency braking, automatic sidelining of cars on notice of any equipment failure and other such car dependent features, the command station monitors and regulates the supply and demand of cars for the network. Each loading station 178 is equipped with input means where passengers can request a car and if no empty cars are at the station, the next available empty car traveling on the service route line 58 proximate the station is shunted to the requesting station for loading.

As shown in FIGS. 12 and 13, a major station 180 may have two station lines 64*a* and 64*b* to accommodate the unloading and loading of passengers. Cars 12*a* that have entered the stations 182 and 180 of FIGS. 12 and 13 respectively, have slowed going over the single-rail switch mechanisms 54, and continue to slow to a stop where cars 14*b* are ready for unloading and loading. Once loaded, or requested to reenter the common line 58 because of insufficient cars elsewhere in the network, the cars 12*c* slowly approach the reentry double-rail switch mechanisms 66. When permitted by the central control sensing adequate car spacing, the reentry car is allowed to enter the common line 58. Cards 12*d* that are not shunted to a station continue on the common line 58 to their passenger determined destination station.

The switching mechanisms 44 of both single and double rail type are sufficiently long such that any failure to signal a timely lock of the locking mechanism after the switch has initiated its displacement, an emergency breaking sequence can halt a car before it reaches the end of switch rail.

Although this invention is primarily directed at the mechanical construction of the system, it is to be understood that such mechanical embodiments of the operational mechanisms are controlled by conventional, state of the art transit control systems.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A monorail transport system comprising:

a plurality of independent light weight cars carrying 1–4 passengers, a monorail track network having a track support structure, supporting a common main line and supporting at least one side line diverting from the main line and reentering the main line;

wherein the side line and main line have fixed track segments and the side line is connected to the main line with a first high-speed switching means for diverting cars from a fixed track segment of the main line to a fixed track segment of the side line, and a second high-speed switching means for reentering cars from a fixed track segment of the side line to a fixed track segment of the main line, while cars not diverted to the side line continue along the main line bypassing the side line;

wherein the fixed track segments have ends and the first and second switching means each includes a low-mass, multi-segment, articulated rail with a first end pivotally connected to an end of one of the fixed track segments and a second distal end selectively connectable to an end of another one of the fixed track segments spaced from the end of said one of the fixed track segments, with the first and second switching means each including at least one high-speed first actuator means mounted to the track support structure and to the multi-segment articulated rail proximate the distal end, and, at least one high-speed second actuator means mounted to the track support structure and to the multi-segment articulated rail intermediate the pivotally connected end and the distal end for rapidly displacing the articulated rail from a first position to a second position; and wherein one end of the side line is positioned to align with the second distal end of one of the articulated rails, and the other end of the side line is connected with the first end of another one of the articulated rails.

2. The monorail transport system of claim 1 wherein the first switching means includes the multi-segment articulated rail having the first end pivotally connected to the end of a fixed track segment on the main line and the second distal end selectively connectable to the end of a fixed track segment on the main line and the end of a fixed track segment on the side line.

3. The monorail transport system of claim 2 wherein the second distal end includes a locking means for locking the distal end of the articulated rail to the main line or side line.

4. The monorail transport system of claim 3 wherein the locking means includes a recess in the distal end of the articulated rail, and wherein the main line and the side line each include a fixed track segment with a displaceable end head in the end of the fixed track segment with actuator means for selectively extending and retracting the end head, wherein the displaceable end head of the end segment of the main line or the side line is selectively engageable in the recess of the distal end of the articulated rail.

5. The monorail transport system of claim 4 wherein the locking means includes a spring bias means for biasing the end head toward the distal end of the articulated rail.

6. The monorail transport system of claim 1 wherein the second switching means includes the multi-segment articulated rail which is a first multi-segment articulated rail having the first end pivotally connected to the end of a fixed track segment on the main line and the second distal end selectively connectable to the end of a fixed track segment on the main line and displaceable from the main line, and, a second-multi-segment articulated rail having a first end pivotally connected to the end of a fixed track segment on the side line and second distal end selectively displaceable from the main line, wherein either the distal end of the first rail or the second rail is connected to the main line.

7. The monorail transport system of claim 6 wherein the end of the fixed segment of the main line selectively connectable to the distal end of the first and second articulated rails includes a locking means for locking the end of the fixed segment of the main line to the distal end of the first rail or the distal end of the second rail.

8. The monorail transport system of claim 7 wherein the locking means includes a displaceable end head with actuator means for retracting the end head, and wherein each of the distal ends of the first and second rails includes an end segment with a recess, wherein the displaceable end head of the locking means is selectively engageable in the recess of one of the end segments of the first rail and second rail.

9. The monorail transport system of claim 6 wherein the locking means includes a spring bias means for biasing the end head toward the distal end of one of the first and second articulated rails.

10. The transport system of claim 1 wherein the actuator means comprise at least one hydraulic actuator.

11. The transport system of claim 1 wherein the multi-segment articulated rail includes at least one rail segment between the intermediate actuator means and the distal actuator means, and at least one rail segment between the intermediate actuator means and the pivotally connected first end of the articulated rail.

* * * * *

UNITED STATES PATENT OFFICE

CERTIFICATE OF CORRECTION

Patent No. 5,218,395 Dated June 8, 1993

Inventor(s) Nobuyuki Taniguchi et al.

It is certified that error appears in the above-identified patent and that said Letters Patent is hereby corrected as shown below:

On the cover sheet, please insert:

--[*] Notice: The portion of the term of this patent subsequent to December 18, 2007, has been disclaimed.--

Signed and Sealed this

Twenty-fifth Day of January, 1994

Bruce Lehman

*Attest:*

BRUCE LEHMAN

*Attesting Officer*

*Commissioner of Patents and Trademarks*